US008922449B2

(12) United States Patent
Wong et al.

(10) Patent No.: US 8,922,449 B2
(45) Date of Patent: Dec. 30, 2014

(54) COMMUNICATION ELECTRONIC DEVICE AND ANTENNA STRUCTURE THEREOF

(75) Inventors: Kin-Lu Wong, New Taipei (TW); Tsung-Ju Wu, New Taipei (TW)

(73) Assignee: Acer Incorporated, Xizhi Dist., New Taipei (TW)

( * ) Notice: Subject to any disclaimer, the term of this patent is extended or adjusted under 35 U.S.C. 154(b) by 212 days.

(21) Appl. No.: 13/449,318

(22) Filed: Apr. 18, 2012

(65) Prior Publication Data

US 2013/0162494 A1 Jun. 27, 2013

(30) Foreign Application Priority Data

Dec. 27, 2011 (TW) ..... 100148862 A

(51) Int. Cl.
*H01Q 1/00* (2006.01)

(52) U.S. Cl.
USPC ..... 343/843

(58) Field of Classification Search
USPC ..... 343/843, 846, 895, 817, 702, 700 MS, 343/814–8
See application file for complete search history.

(56) References Cited

U.S. PATENT DOCUMENTS 7,315,289 B2 * 1/2008 Puente Baliarda et al. ... 343/817
7,760,146 B2 * 7/2010 Ollikainen ..... 343/702
8,472,908 B2 * 6/2013 Anguera et al. ..... 455/272
8,593,353 B2 * 11/2013 Byun et al. ..... 343/702
8,618,990 B2 * 12/2013 Somero ..... 343/702
2002/0180649 A1 12/2002 Iguchi
2006/0197538 A1 * 9/2006 Leinonen et al. ..... 324/533

FOREIGN PATENT DOCUMENTS

EP 2 117 073 A1 11/2009

OTHER PUBLICATIONS

Kin-Lu Wong et al., Bandwidth Enhancement of Small-Size Planar Tablet Computer Antenna Using a Parallel-Resonant Spiral Slit, IEEE Transactions on Antennas and Propagation, vol. 60, No. 4, Apr. 2012, p. 1705-1711, XP011440901, 2012 IEEE.

* cited by examiner

*Primary Examiner* — Huedung Mancuso
(74) *Attorney, Agent, or Firm* — Winston Hsu; Scott Margo

(57) ABSTRACT

An antenna structure having a ground element and an antenna element is provided. The antenna element is disposed on a dielectric substrate, and includes a first radiation portion, a second radiation portion, and a spiral metal line. An end of the first radiation portion is a feeding point of the antenna element, and another end is open. An end of the second radiation portion is electrically coupled to the ground element, and the length of the second radiation portion is greater than that of the first radiation portion. The first radiation portion is surrounded by the second radiation portion. An end of the spiral metal line is coupled to the first radiation portion. The spiral metal line contributes a parallel resonance outside the antenna's operating band, and results in a resonant mode generated within the antenna element's operating band such that the operating bandwidth of the antenna element is increased.

16 Claims, 7 Drawing Sheets

COMMUNICATION ELECTRONIC DEVICE AND ANTENNA STRUCTURE THEREOF

BACKGROUND OF THE INVENTION

1. Field of the Invention

The present invention relates generally to a communication electronic device and an antenna structure thereof, and more particularly, to a communication electronic device having a small-size planar antenna utilizing parallel resonance to generate multi-band operation.

2. Description of the Prior Art

With the rapid development of mobile communication technologies and markets, wireless access capabilities are indispensable to portable communication electronic devices. In addition to wireless local area network (WLAN), wireless wide area network (WWAN) is able to provide services over a wide coverage, and long term evolution (LTE) technology can provide higher data rates, thereby improving convenience and providing real time in wireless access while using the portable communication electronic devices. On the other hand, slim-profile design is becoming more attractive in market for the communication electronic device. Hence, it is critical to design a planar printed antenna having the capability of covering multi-band operation for a slim mobile device.

U.S. Patent (U.S. Pat. No. 7978141 B2) entitled "Coupled-fed multi-band loop antenna" discloses designing a dual-band antenna used in a communication electronic device, wherein the antenna has two operating bands. However, the lower operating band of the antenna fails to cover multi-band operation. As a result, such an antenna cannot be applied for covering all the lower operating bands in the WWAN or LTE system.

Apparently, it is necessary to provide a communication electronic device, which has two wide operating bands. For example, the operating bands can cover 824~960 MHz as well as 1710~2170 MHz. Additionally, the antenna element should have the attractive characteristics of planar structure and small size.

SUMMARY OF THE INVENTION

The present invention provides a communication electronic device having a built-in antenna element. The antenna element has a spiral metal line, which can increase an operating bandwidth of the antenna element. As the spiral metal line has a small size, it therefore does not increase the size of the antenna element. Therefore, the antenna element of the present invention has the advantages of small size, planar structure, and multi-band operation.

According to a first aspect of the present invention, a communication electronic device has an antenna structure. The antenna structure comprises a ground element and an antenna element that is disposed on a dielectric substrate. The antenna element comprises a first radiation portion, a second radiation portion and a spiral metal line, wherein a first end of the first radiation portion is a feeding point of the antenna element, and a second end is an open end. One end of the second radiation portion is electrically coupled to the ground element. The second radiation portion is extended around the open end of the first radiation portion. A first end of the spiral metal line is electrically coupled to the first radiation portion. The spiral metal line contributes a parallel resonance at a frequency outside an operating band of the antenna element. The parallel resonance further contributes a resonant mode in the operating band, thereby increasing an operating bandwidth of the antenna element.

According to a second aspect of the present invention, an antenna structure comprises a ground element and an antenna element that is disposed on a dielectric substrate. The antenna element comprises a first radiation portion, a second radiation portion and a spiral metal line, wherein a first end of the first radiation portion is a feeding point of the antenna element, and a second end is an open end. One end of the second radiation portion is electrically coupled to the ground element. The second radiation portion is extended around the open end of the first radiation portion. A first end of the spiral metal line is electrically coupled to the first radiation portion. The spiral metal line contributes a parallel resonance at a frequency outside an operating band of the antenna element. The parallel resonance further contributes a resonant mode in the operating band, thereby increasing an operating bandwidth of the antenna element.

In one exemplary embodiment of the present invention, the second radiation portion of the antenna element generates a resonant mode at lower frequencies. The higher-order resonant mode of the second radiation portion can further combine with a resonant mode generated by the first radiation portion at higher frequencies to increase the operating bandwidth. Additionally, with the addition of the spiral metal line, the first end of the spiral metal line is electrically coupled to the first radiation portion, which generates a parallel resonance at a frequency outside the lower operating band of the antenna element. The parallel resonance will in turn generate a resonant mode in the lower operating band, which will be combined with the original resonant mode generated by the second radiation portion to increase the operating bandwidth of the antenna element.

In one exemplary embodiment of the present invention, the size of the antenna is only $12\times40$ mm$^2$, and is able to cover the penta-band WWAN operation (824~960/1710~2170 MHz), thereby obtaining the advantages of small size, planar structure, and multi-band operation.

These and other objectives of the present invention will no doubt become obvious to those of ordinary skill in the art after reading the following detailed description of the preferred embodiment that is illustrated in the various figures and drawings.

DETAILED DESCRIPTION

The following description is of the best-contemplated mode of carrying out the present invention. A detailed description is given in the following embodiments with reference to the accompanying drawings.

Certain terms are used throughout the following descriptions and claims to refer to particular system components. As one skilled in the art will appreciate, manufacturers may refer to a component by different names. This document does not intend to distinguish between components that differ in name but not differ in functionality. In the following discussion and in the claims, the terms "include", "including", "comprise", and "comprising" are used in an open-ended fashion, and thus should be interpreted to mean "including, but not limited to . . . " The terms "couple" and "coupled" are intended to mean either an indirect or a direct electrical connection. Thus, if a first device couples to a second device, that connection may be through a direct electrical connection, or through an indirect electrical connection via other devices and connections.

Figure 1A:
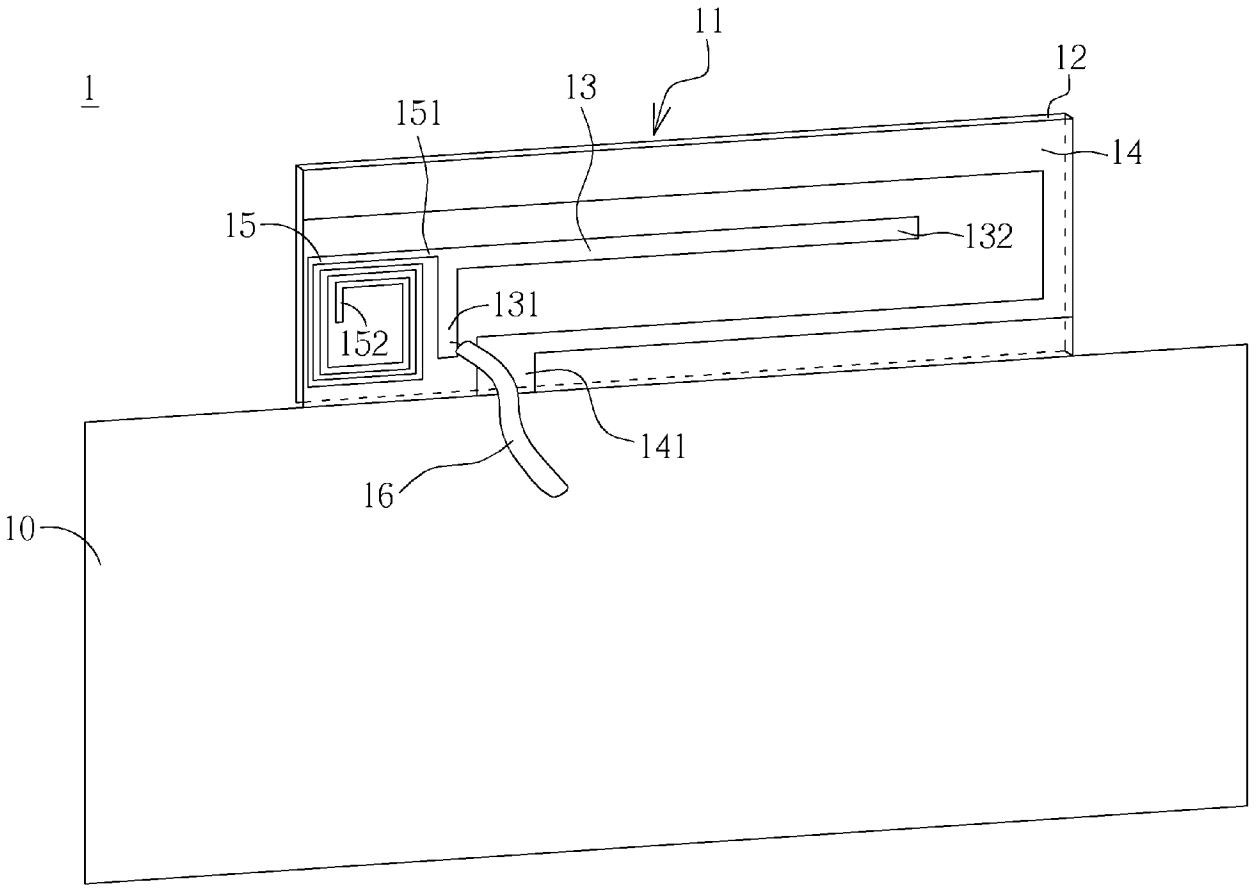
FIG. 1A is a structural drawing of a communication electronic device with an antenna structure according to a first exemplary embodiment of the present invention.
Figure 1B:
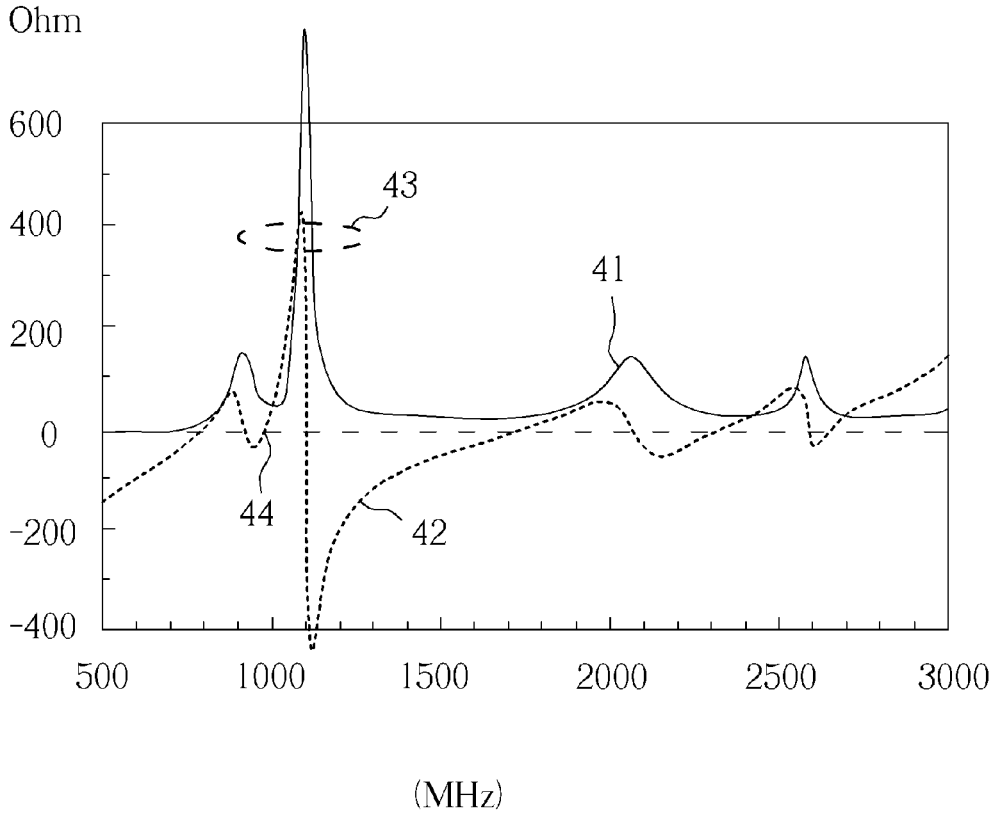
FIG. 1B is a diagram illustrating input impedance of the communication electronic device with the antenna structure.
Figure 3:
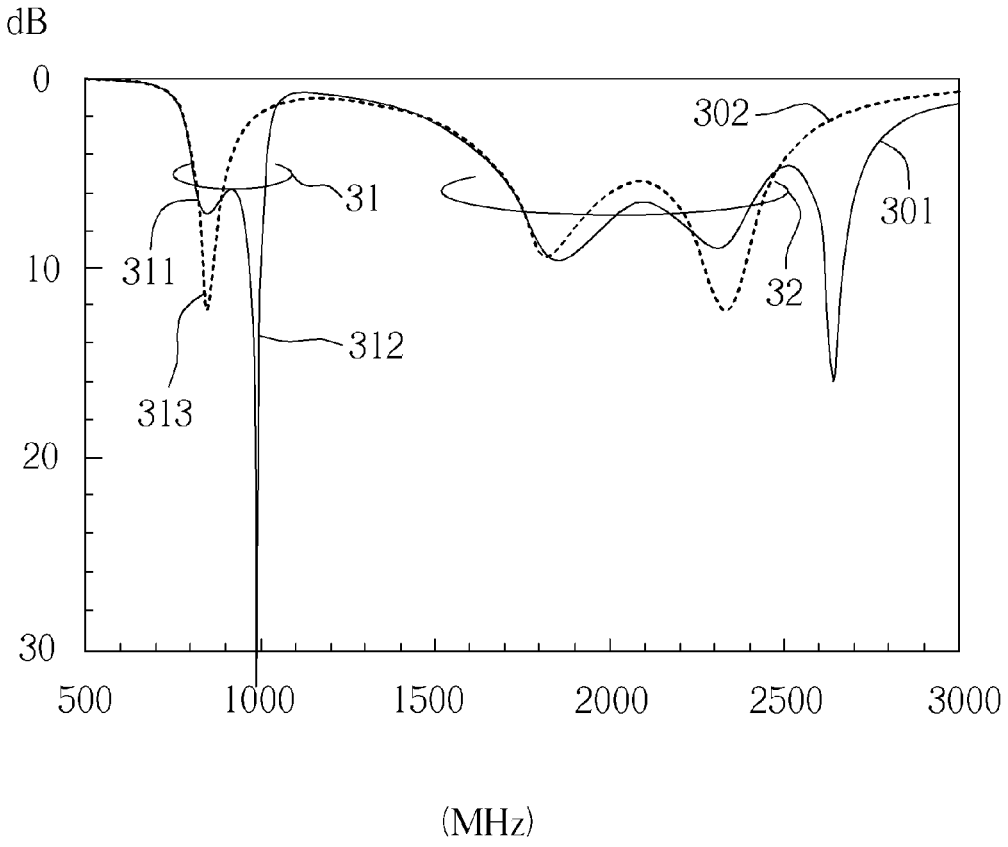
FIG. 3 is a diagram illustrating return loss of the communication electronic device of FIG. 1 and the conventional communication electronic device of FIG. 2.

Please refer to FIG. 1A in conjunction with FIG. 1B. FIG. 1A is a structural drawing of a communication electronic device with an antenna structure 1 according to a first exemplary embodiment of the present invention. FIG. 1B is a diagram illustrating the input impedance of the communication electronic device with the antenna structure 1 according to the first exemplary embodiment of the present invention. In the first exemplary embodiment, the communication electronic device with the antenna structure 1 comprises a ground element 10 and an antenna element 11. The antenna element 11 is disposed on a dielectric substrate 12, and comprises a first radiation portion 13, a second radiation portion 14 and a spiral metal line 15. A first end of the first radiation portion 13 is a feeding point 131 of the antenna element 11, the signal is fed through a coaxial line 16 connected thereto. Additionally, a second end of the first radiation portion 13 is an open end 132. One end 141 of the second radiation portion 14 is electrically coupled to the ground element 10. A length of the second radiation portion 14 is greater than that of the first radiation portion 13. The second radiation portion 14 is extended around the open end 132 of the first radiation portion 13. A first end 151 of the spiral metal line 15 is electrically coupled to the first radiation portion 13. The spiral metal line 15 can contribute a parallel resonance 43 (as shown in FIG. 1B) at a frequency outside a lower band 31 (shown in FIG. 3) of the antenna element 11. The parallel resonance 43 generates an additional resonant mode 312 (as shown in FIG. 3) in the lower band 31 such that an operating bandwidth of the antenna in the lower band 31 can be increased. It should be noted that, in this embodiment, the first radiation portion 13 is implemented using a monopole antenna.

Further, in this embodiment, a second end 152 of the spiral metal line 15 is an open end and spirals inward. The spiral metal line 15 spirals in a rectangular shape. However, these should not be considered as limitations of the present invention. Additionally, in this embodiment, the length of the spiral metal line 15 is close to one quarter of a wavelength of the center frequency of the parallel resonance 43 (as shown in FIG. 1B).

Figure 2A:
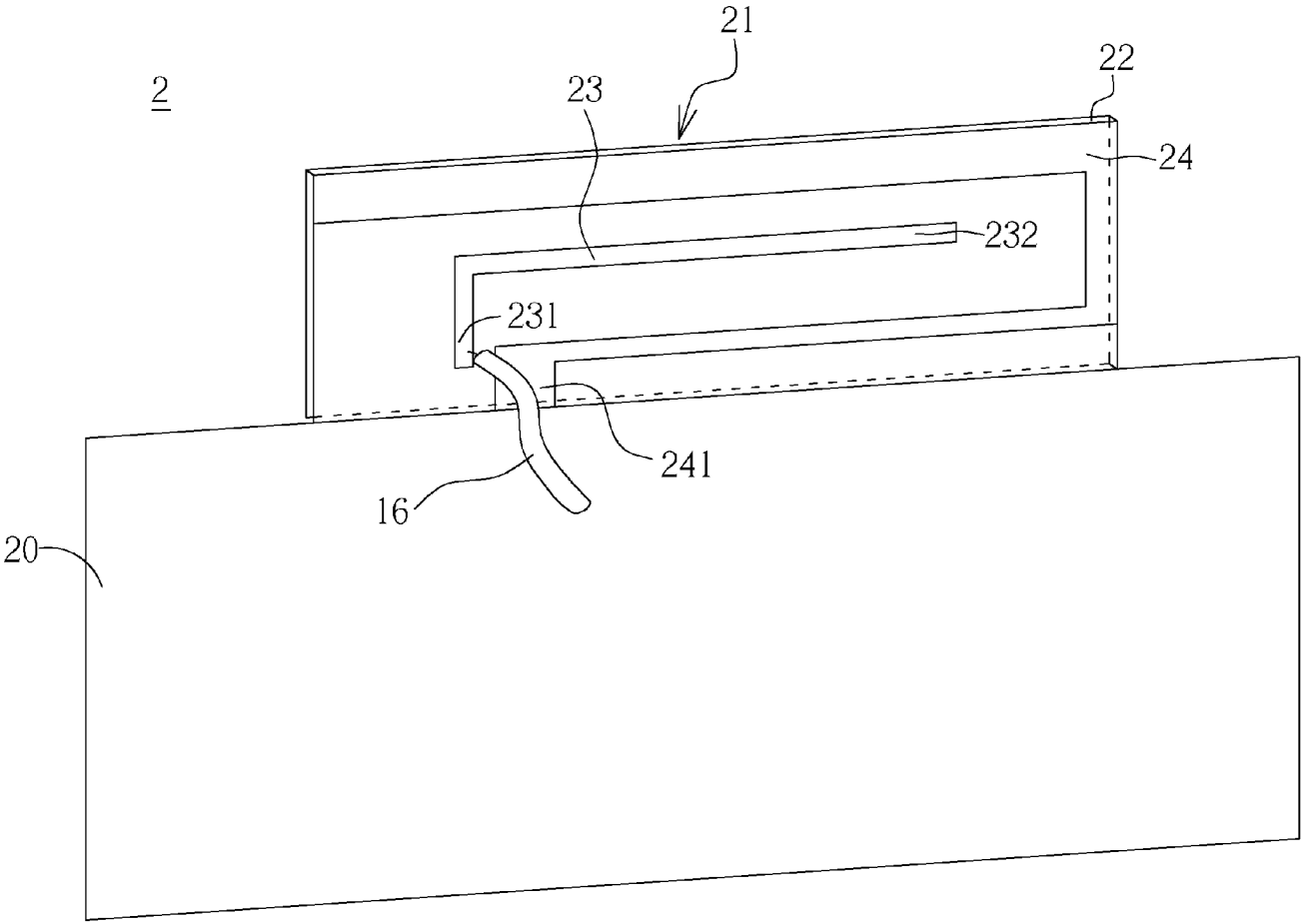
FIG. 2A is a structural drawing of a conventional communication electronic device with a conventional antenna structure.
Figure 2B:
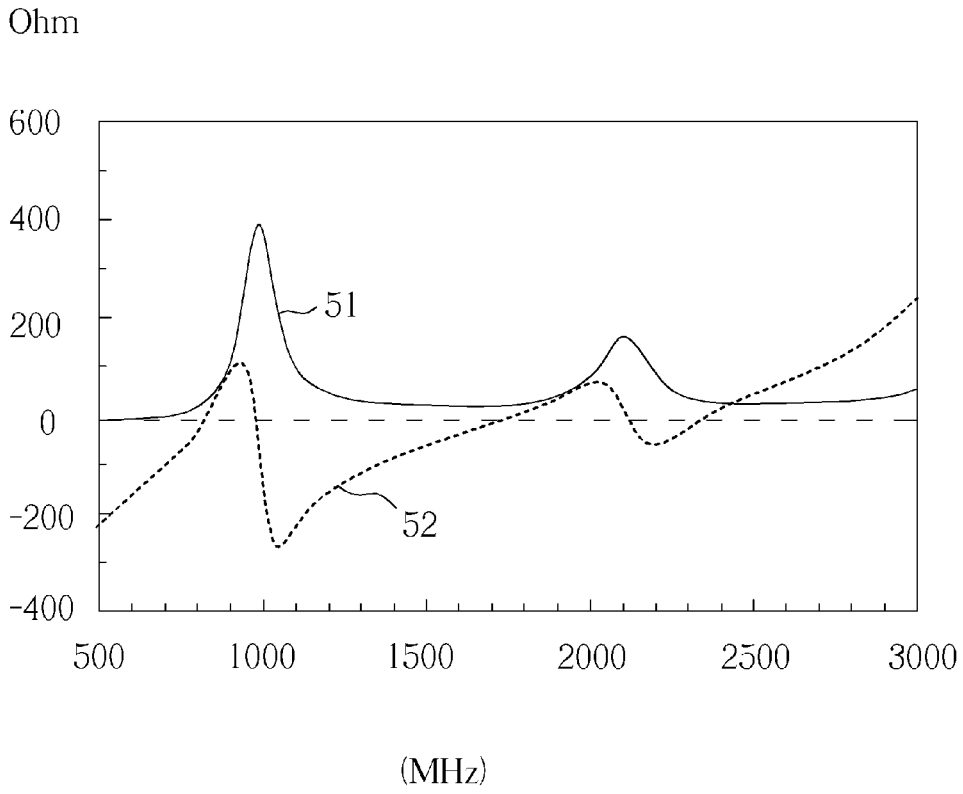
FIG. 2B is a diagram illustrating input impedance of the conventional communication electronic device with the conventional antenna structure.

Please refer to FIG. 2A in conjunction with FIG. 2B. FIG. 2 is a structural drawing of a conventional communication electronic device with a conventional antenna structure 2 thereof. FIG. 2B is a diagram illustrates input impedance of the conventional communication electronic device with the conventional antenna structure 2. As shown in FIG. 2A, the communication electronic device and the antenna structure 2 comprise a ground element 20 and an antenna element 21. The antenna element 21 is disposed on a dielectric substrate 22, and comprises a first radiation portion 23 and a second radiation portion 24. A first end of the first radiation portion 23 is a feeding point 231 of the antenna element 21, and the signal is fed through a coaxial line 26 connected thereto. The second end of the first radiation portion 23 is an open end 232. The first radiation portion 23 can contribute a resonant mode (as shown in FIG. 3) at a higher band 32 of the antenna element 21. A first end 241 of the second radiation portion 24 is electrically coupled to the ground element 20. A length of the second radiation portion 24 is greater than that of the first radiation portion 23. The second radiation portion 24 is extended around the open end 232 of the first radiation portion 23. Also, the second radiation portion 24 can contribute a resonant mode (e.g. the resonant mode 313 shown in FIG. 3) at a lower band 31 of the antenna element 21. However, the bandwidth of the resonant mode is narrow, which fails to cover multi-band operation.

The difference between the communication electronic device with the antenna structure 1 of FIG. 1 and the conventional communication electronic device with the conventional antenna structure 2 is that the antenna element 11 of the communication electronic device with the antenna structure 1 additionally includes the spiral metal line 15. With the spiral metal line 15, a parallel resonance can be generated at a frequency outside the lower band of the antenna element 11. The parallel resonance will in turn generate a resonant mode in the lower band, which can be further combined with the original resonant mode of the second radiation portion, thereby increasing the operating bandwidth of the antenna element 11.

Please refer to FIG. 3, which is a diagram illustrating return loss of the communication electronic device 1 as shown in FIG. 1A and the conventional communication electronic device 2 as shown in FIG. 2A. In the first exemplary embodiment, the first radiation portion 13 of the communication electronic device 1 generates at least one resonant mode in a second (higher frequency) operating band 32. The second radiation portion 14 of the communication electronic device 1 generates at least one resonant mode in the first (lower frequency) operating band 31.

Please refer to FIG. 1B in conjunction with FIG. 2B and FIG. 3. FIG. 1B is a diagram illustrating the input impedance of the communication electronic device with the antenna structure 1. FIG. 2B is a diagram illustrating the input impedance of the conventional communication electronic device with the antenna structure 2. FIG. 3 is a diagram illustrating return loss of the communication electronic device 1 of FIG. 1A and the conventional communication electronic device 2 of FIG. 2A. As shown in FIG. 1B, the input impedance of the communication electronic device 1 has a real part 41 and an imaginary part 42. As shown in FIG. 2B, the input impedance of the communication electronic device 2 has a real part 51 and an imaginary part 52.

In the communication device shown in FIG. 2A, a length of the ground element 20 is about 150 mm and a width of the ground element 20 is about 200 mm; a length of the dielectric substrate 22 is about 40 mm, a width of the dielectric substrate 22 is about 12 mm and a thickness of the dielectric substrate 22 is about 0.8 mm. A length of the first radiation portion 23 is about 30 mm and a length of second radiation portion 24 is about 75 mm. The second radiation portion 24 can cause a quarter-wavelength resonant mode 313. Since the impedance of the resonant mode 313 has a larger real part, the bandwidth of the resonant mode 313 will be narrow and fail to cover multi-band operation with the 6-dB return-loss definition (which is the design specification widely used for the mobile communication device antennas). In the communication electronic device 1 as shown in FIG. 1, the sizes of the elements are chosen as the similar sizes of the elements of the conventional communication electronic device 2 shown in FIG. 2A. Further, a length of the spiral metal line 15 is about 60 mm. The second radiation portion 14 can cause the quarter-wavelength resonant mode 311 and the higher-order resonant mode. The spiral metal line 15 can contribute a parallel resonance 43 (having a center frequency at about 1.1 GHz) at a frequency outside the lower band 31 of the antenna element 11. The parallel resonance 43 generates an additional resonance around the resonant mode 311 (e.g. the zero imaginary part of the impedance as shown in FIG. 1B), thereby generating a resonant mode 312. The resonant mode 312 and the resonant mode 311 generated by the second radiation portion 14 collectively generate the first (lower frequency) operating band (e.g. the operating band 31 shown in FIG. 3) . The first radiation portion 13 can cause a quarter-wavelength resonant mode. The quarter-wavelength resonant mode and the higher-order resonant mode generated by the second radiation portion 14 collectively generate the second (higher frequency) operating band (e.g. the operating band 32 shown in FIG. 3). Under the definition of 6 dB return loss, the first operating band 31 covers at least the dual-band operation of GSM850/900 (from about 824 to 960 MHz). The second operating band 32 covers at least the triple-band operation of GSM1800/1900/UMTS (from about 1710 to 2170 MHz). Compared to the conventional communication electronic device 2, the operating bandwidth of the communication electronic device 1 is significantly increased by the spiral metal line 15, thereby allowing the first operating band 31 to achieve multi-band operation.

Figure 4:
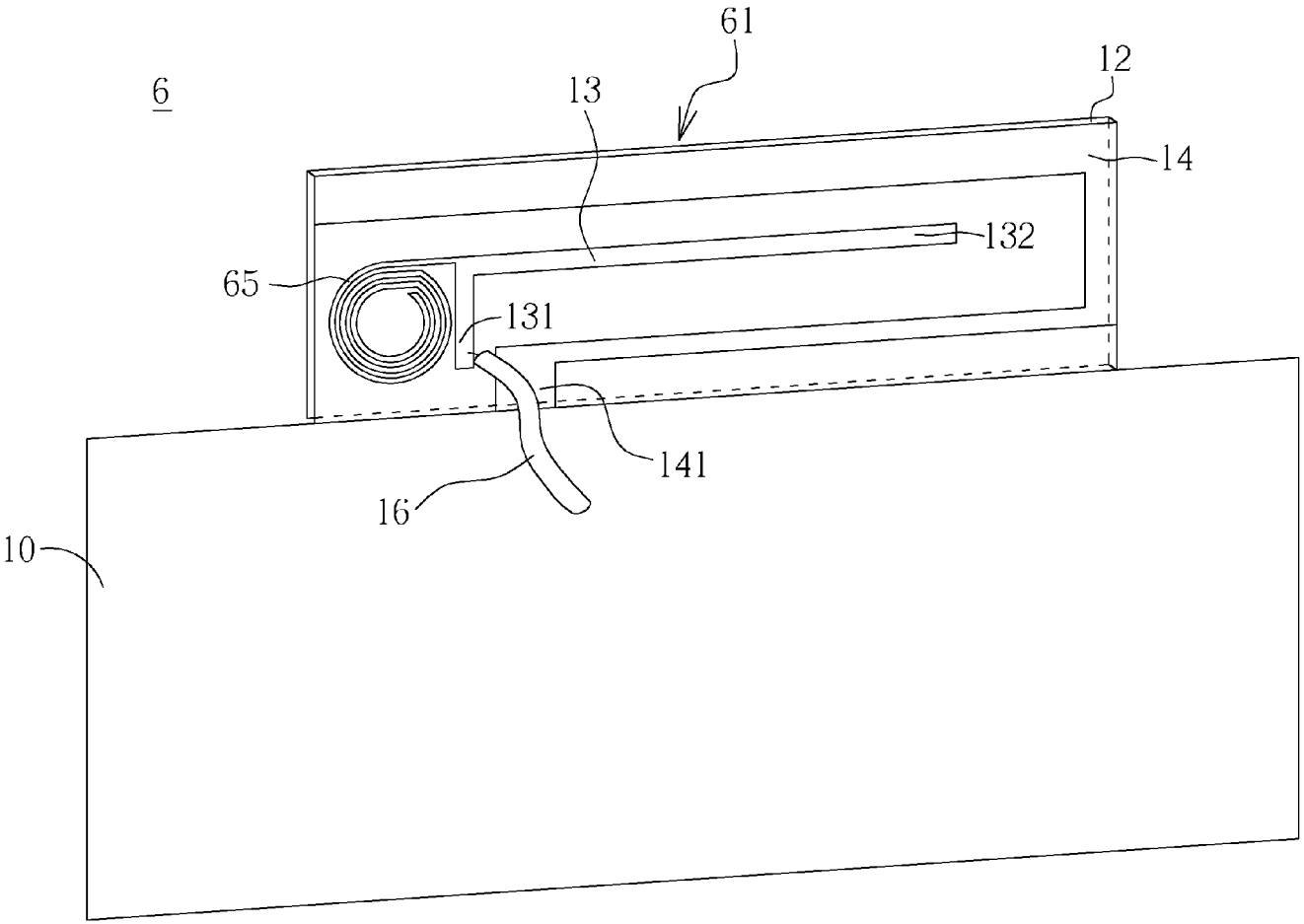
FIG. 4 is a structural drawing of a communication electronic device with an antenna structure according to a second exemplary embodiment of the present invention.

Please refer to FIG. 4, which is a structural drawing of a communication electronic device with an antenna structure 6 thereof according to a second exemplary embodiment of the present invention. In the second exemplary embodiment, the antenna structure is basically similar to the antenna structure of the first exemplary embodiment. However, the difference between these two exemplary embodiments is that structures of the antenna element 61 and the spiral metal line 65 are changed. In the second exemplary embodiment, the spiral metal line 65 can spiral in circular shapes. Since the antenna structure of the second exemplary embodiment is similar to that of the first exemplary embodiment, effects of the second exemplary embodiment are also similar to those of the first exemplary embodiment.

Figure 5:
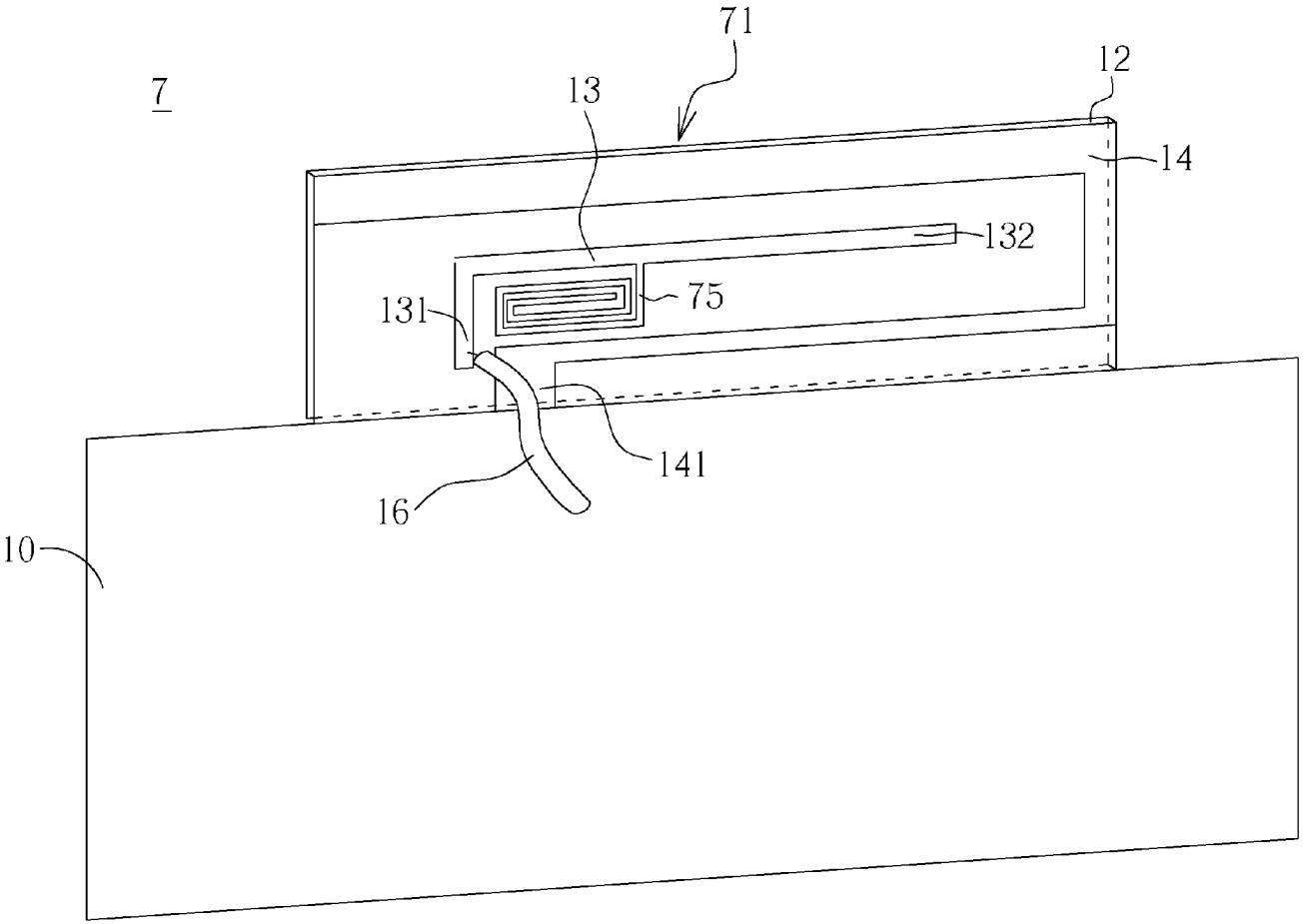
FIG. 5 is a structural drawing of a communication electronic device with an antenna structure according to a third exemplary embodiment of the present invention.

Please refer to FIG. 5, which is a structural drawing of a communication electronic device with an antenna structure 7 according to a third exemplary embodiment of the present invention. The antenna structure of the third exemplary embodiment is basically similar to the antenna structure of the first exemplary embodiment. The difference between the antenna structures of these two exemplary embodiments is that the position to which the antenna element 71 and the spiral metal line 75 are electrically coupled is changed. Also, the spiral metal line 75 is adjusted to determine the center frequency of the parallel resonance generated by the spiral metal line 75. Since the antenna structure of the third exemplary embodiment is similar to that of the first exemplary embodiment, effects of the third exemplary embodiment are also similar to those of the first exemplary embodiment.

The abovementioned embodiments are presented merely to illustrate practicable designs of the present invention, and in no way should be considered to be limitations of the scope of the present invention Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A communication electronic device with an antenna structure, the antenna structure comprising:

a ground element; and an antenna element, disposed on a dielectric substrate, comprising:

a first radiation portion, having a first end as a feeding point of the antenna element, and a second end as an open end;

a second radiation portion, having one end electrically coupled to the ground element, wherein a length of the second radiation portion is greater than that of the first radiation portion, and the second radiation portion is extended around the open end of the first radiation portion; and a spiral metal line, having a first end electrically coupled to the first radiation portion, wherein the spiral metal line contributes a parallel resonance at a frequency outside an operating band of the antenna element, and the parallel resonance contributes a resonant mode in the operating band to increase an operating bandwidth of the antenna element.

2. The communication electronic device of claim 1, wherein the first radiation portion is a monopole antenna.

3. The communication electronic device of claim 1, wherein a second end of the spiral metal line is an open end and spirals inward.

4. The communication electronic device of claim 1, wherein the spiral metal line spirals in rectangular shapes or in circular shapes.

5. The communication electronic device of claim 1, wherein the spiral metal line is disposed between the first radiation portion and the second radiation portion.

6. The communication electronic device of claim 1, wherein a length of the spiral metal line is close to one quarter of a wavelength of a center frequency of the parallel resonance.

7. The communication electronic device of claim 1, wherein the antenna element has a first operating band and a second operating band, and the first operating band covers about 824 to 960 MHz, and the second operating band covers about 1710 to 2170 MHz.

8. The communication electronic device of claim 1, wherein the second radiation portion contributes at least a first resonant mode in the first operating band, and the first radiation portion contributes at least a second resonant mode in the second operating band.

9. An antenna structure, comprising:

a ground element; and an antenna element, disposed on a dielectric substrate, comprising:

a first radiation portion, having a first end as a feeding point of the antenna element, and a second point as an open end;

a second radiation portion, having one end electrically coupled to the ground element, wherein a length of the second radiation portion is greater than that of the first radiation portion, and the second radiation portion is extended around the open end of the first radiation portion; and a spiral metal line, having a first end electrically coupled to the first radiation portion, wherein the spiral metal line contributes a parallel resonance at a frequency outside an operating band of the antenna element, and the parallel resonance contributes a resonant mode in the operating band to increase an operating bandwidth of the antenna element.

10. The antenna structure of claim 9, wherein the first radiation portion is a monopole antenna.

11. The antenna structure of claim 9, wherein a second end of the spiral metal line is an open end and spirals inward.

12. The antenna structure of claim 9, wherein the spiral metal line spirals in rectangular shapes or in circular shapes.

13. The antenna structure of claim 9, wherein the spiral metal line is disposed between the first radiation portion and the second radiation portion.

14. The antenna structure of claim 9, wherein a length of the spiral metal line is close to one quarter of a wavelength of a center frequency of the parallel resonance.

15. The antenna structure of claim 9, wherein the antenna element has a first operating band and a second operating band, and the first operating band covers about 824 to 960 MHz, and the second operating band covers about 1710 to 2170 MHz.

16. The antenna structure of claim 15, wherein the second radiation portion contributes at least a first resonant mode in the first operating band, and the first radiation portion contributes at least a second resonant mode in the second operating band.

* * * * *